US007041033B2

(12) United States Patent
Tom

(10) Patent No.: US 7,041,033 B2
(45) Date of Patent: May 9, 2006

(54) NECK EXERCISE APPARATUS

(76) Inventor: James L. Tom, 6551 Colton Blvd., Oakland, CA (US) 94611

( * ) Notice: Subject to any disclaimer, the term of this patent is extended or adjusted under 35 U.S.C. 154(b) by 136 days.

(21) Appl. No.: 10/838,012

(22) Filed: May 3, 2004

(65) Prior Publication Data

US 2005/0245356 A1 Nov. 3, 2005

(51) Int. Cl.
*A63B 21/02* (2006.01)
*A63B 23/025* (2006.01)

(52) U.S. Cl. ..... 482/10; 482/121; 482/127; 482/129; 601/39

(58) Field of Classification Search ..... 482/10, 482/11, 26–28, 30, 32, 44, 74, 77, 83, 91, 482/92, 121–130, 132; 601/39; 5/622, 640, 5/642, 643
See application file for complete search history.

(56) References Cited

U.S. PATENT DOCUMENTS

| | | | | |
|---|---|---|---|---|
| 436,462 | A | 9/1890 | Reach | |
| 944,648 | A * | 12/1909 | Austin | 482/83 |
| 3,058,743 | A | 10/1962 | Gabrielson | |
| 3,219,358 | A | 11/1965 | Hagner | |
| 3,466,031 | A * | 9/1969 | Boykin, Jr. | 482/27 |
| 3,765,693 | A | 10/1973 | Morrison | |
| 4,018,438 | A | 4/1977 | Shogar | |
| 4,199,136 | A | 4/1980 | Mansfield | |
| 4,428,577 | A | 1/1984 | Weingardt | |
| 4,789,154 | A | 12/1988 | Mattox | |
| 4,893,808 | A | 1/1990 | McIntyre | |
| 5,005,832 | A | 4/1991 | Van Der Hoeven | |
| 5,116,359 | A | 5/1992 | Moore | |
| 5,135,445 | A | 8/1992 | Christensen et al. | |
| 5,273,504 | A | 12/1993 | Jones | |
| 5,336,138 | A | 8/1994 | Arjawat | |
| 5,336,141 | A | 8/1994 | Vittone | |
| 5,501,646 | A | 3/1996 | Miller | |
| 5,562,575 | A | 10/1996 | Gvoich | |
| 5,669,862 | A | 9/1997 | Sayman | |
| 5,993,357 | A | 11/1999 | Tom et al. | |
| 6,910,698 | B1 * | 6/2005 | Turner et al. | 280/87.042 |

* cited by examiner

*Primary Examiner*—Gregory L. Huson
*Assistant Examiner*—Victor K. Hwang

(57) ABSTRACT

A neck exercise apparatus comprises a thin elongate leaf spring spanning between two supports. One or both of the supports includes a clamping actuator configured for clamping the leaf spring to the support during exercise. The actuator is also configured for releasing the clamping force, thereby permitting adjustment of the position of the support along the length of the leaf spring. Lower ends of the supports are configured to permit the supports to pivot over a flat support surface as the leaf spring is flexed during exercise.

20 Claims, 2 Drawing Sheets

Fig. 1
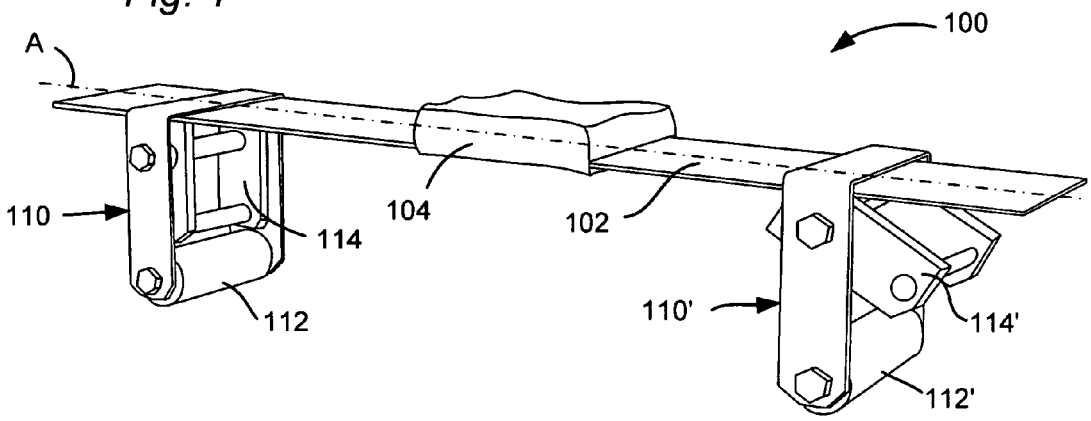
Fig. 2
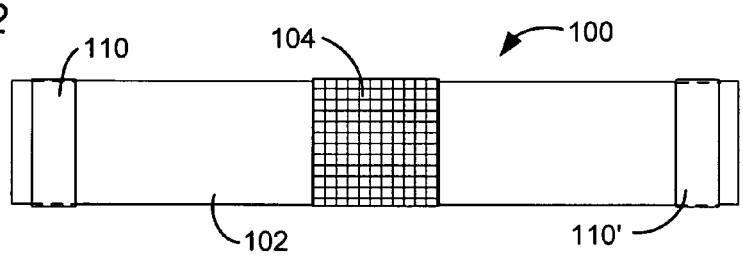
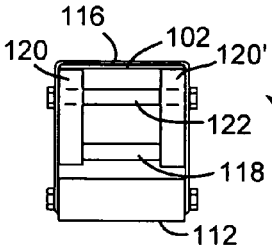
Fig. 4
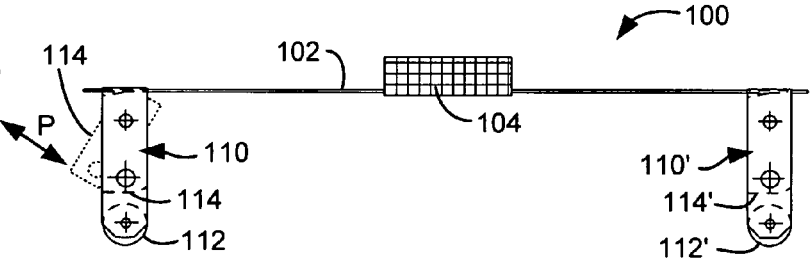
Fig. 3
Fig. 5
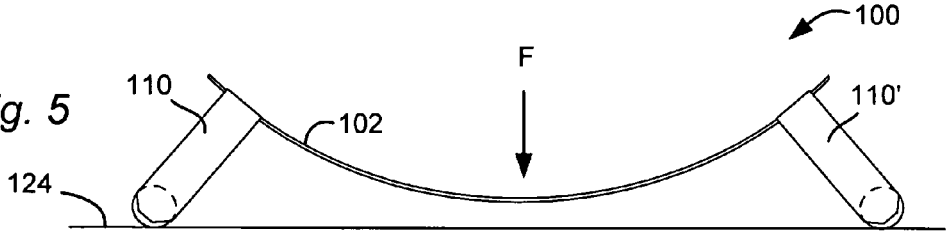

NECK EXERCISE APPARATUS

BACKGROUND OF THE INVENTION

1. Field of the Invention

The present invention relates to exercise equipment, particularly to an apparatus for exercising the neck.

2. Description of Related Art

U.S. Pat. No. 5,993,357 (Tom et al.), which is incorporated herein by reference, discloses a neck exercise device comprising a leaf spring and two opposing supports. At least one of the supports can be moved along the length of the spring, thereby permitting adjustment of the resistance offered by the leaf spring. The two opposing supports are mounted, in turn, on a base underneath the spring. Notwithstanding its advantages, it remains nonetheless desirable to further reduce the weight and cost of this design, while retaining or improving on its functionality as a neck exercise device.

SUMMARY OF THE INVENTION

The present invention provides a neck exercise device that overcomes the limitations of prior art exercise devices. The exercise device comprises a flat leaf spring for providing resistance against flexure of the neck during the exercise. Advantageously, the leaf spring comprises a fiber/resin composite material, such as a carbon composite. In the alternative, spring steel or other spring material may be employed. A cushioning pad may be disposed on an upper surface of the leaf spring, configured for sliding along a length of the spring.

The leaf spring may be supported by two opposing supports disposed toward opposite ends of the spring. At least one of the supports may be configured for releaseably clamping the leaf spring between opposing adjustable clamping surfaces adjacent to an upper end of the support. The other of the supports may be configured identically or similarly to the first support. In the alternative, the second support may be attached to an undersurface of the leaf spring using one or more fasteners, or may be welded or bonded to the leaf spring at the upper end of the support.

Advantageously, the neck exercise device does not include a base underneath the supports, although a base may be provided, if desired. Instead, a lower end of each support is configured for resting freely on any suitable flat firm surface, such as, for example, a table top or floor. A lower end of each support may be configured for pivoting in a plane parallel to a principal plane of flexure of the leaf spring when the spring is flexed during use. For example, the lower end of each supported may be rounded, for example, as a half-cylinder transverse to the length of the leaf spring. In the alternative, the lower end of one or both supports may be provided with a roller to permit both pivoting and rolling along the support surface.

To exercise the neck using the device, a user may position the device with the leaf spring positioned horizontally, and the two supports secured clamped or attached to the leaf spring and resting on the support surface. For example, the user may lie on the floor and position the exercise device underneath his head. In the alternative, the user may set the exercise device on a table top, with the user positioned on a chair adjacent to the device. If the leaf spring is provided with an adjustable pad, the user may position the pad so it is positioned centrally between the two supports. The entire unit may be operated while encased in a protective covering, for example, in a plastic or fabric bag. A suitable covering may prevent the user's hair from becoming entangled in the device, and/or aid in maintaining the device in a clean and sanitary condition.

Then, the user rests his head on the pad and flexes his neck to move his head through a range of motion against the resistance of the leaf spring. This basic motion may be repeated through a set of any desired number of repetitions. The user may assume different positions relative to the leaf spring during flexure, including with the forehead, back of the head, or either side of the head in contact with the spring during a given set. To adjust the amount of resistance offered by the leaf spring, one or both of the supports may be moved towards the center of the leaf spring, thereby shortening the span. Advantageously, the supports are substantially identical, and are supported by a rolling element on the support surface. Thus, both supports roll and pivot in the same way over the support surface, helping to ensure that the resistance provided by the leaf spring is balanced and symmetrical.

The absence of a requirement for a base for the exercise device advantageously reduces its the weight and cost. For still greater portability, in an embodiment of the invention, the supports are readily removed from the leaf spring, so that the device may be collapsed into a smaller volume for transport or storage. Additionally, the supports and leaf spring are readily provided at an affordable cost.

A more complete understanding of the neck exercise apparatus will be afforded to those skilled in the art, as well as a realization of additional advantages and objects thereof, by a consideration of the following detailed description of the preferred embodiment. Reference will be made to the appended sheets of drawings which will first be described briefly.

BRIEF DESCRIPTION OF THE DRAWINGS

FIG. 1 is a perspective view showing an exemplary neck exercise apparatus according to the invention.

FIG. 2 is a plan view of the exemplary neck exercise apparatus shown in FIG. 1.

FIG. 3 is a side view of the exemplary neck exercise apparatus shown in FIG. 1.

FIG. 4 is an end view of the exemplary neck exercise apparatus shown in FIG. 1.

FIG. 5 is a side view showing the exemplary neck exercise apparatus shown in FIG. 1 in a flexed position, under a force "F" that may be exerted by a user.

DETAILED DESCRIPTION OF THE PREFERRED EMBODIMENT

Figure 6:
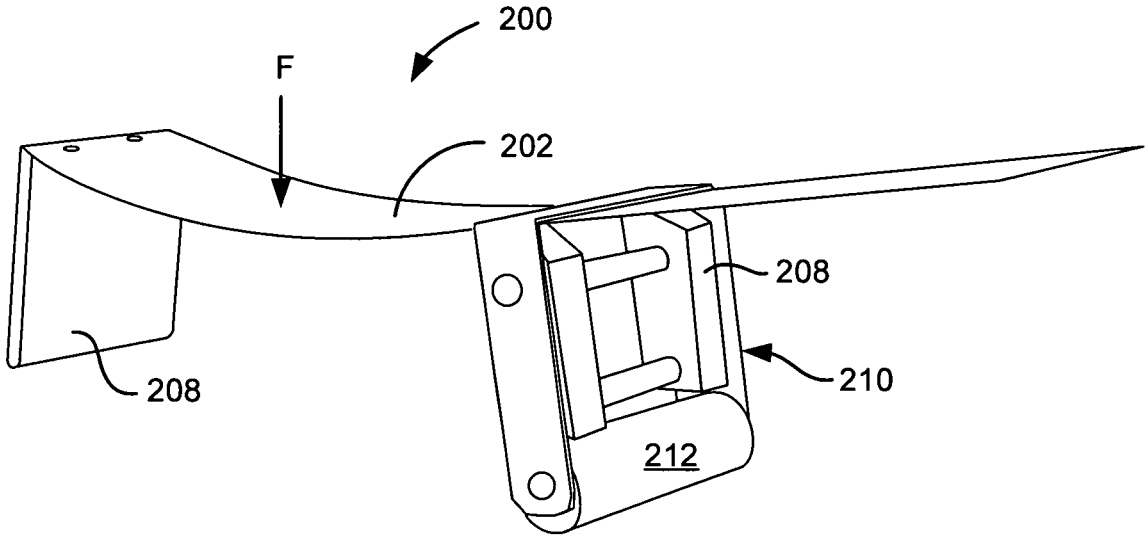
FIG. 6 shows an exemplary neck exercise apparatus, wherein one of the leaf spring supports comprises a fixed member.

The present invention provides a neck exercise apparatus, that overcomes the limitations of the prior art. In the detailed description that follows, like numerals are used to point out like elements appearing in one or more of the figures.

FIG. 1 shows an exemplary neck exercise apparatus 100, comprising a thin elongate leaf spring 102 supported by first support 110 and second support 110'. Suitable materials for leaf spring 102 may include, for example, sheets of spring steel, stainless steel, or other spring metals, or a fiber-composite material, such as a carbon-fiber composite.

Supports 110, 110' each comprise an actuator 114, 114' configured to move between a clamped position clamping the leaf spring between the clamp and an upper portion of the first support, and a released position retaining the leaf spring while permitting the leaf spring to slide relative to the first support. The actuator 114 of support 110 is shown in a clamped position. Actuator 114' of support 110' is shown in a released position. During neck exercise, both actuators are maintained in a clamped position.

When an actuator 114, 114' is in a clamped position, the leaf spring is firmly held to the upper support. When in a released position, the leaf spring is free to slide between the upper portion of its respective support 110, 110' and the corresponding actuator 114, 114'. A user may easily adjust the position of a support relative to the leaf spring by releasing the actuator, sliding the support to the desired position, and moving the actuator back to its clamped position. If desired, one or both supports may be easily be removed entirely from leaf spring 102 when the actuator is in a released position, for more compact storage or packaging of apparatus 100. To re-assemble the apparatus, the leaf spring is simply inserted between the upper portion of each support and the corresponding clamp; the supports are slid to their desired positions, and clamped in place.

Leaf spring 102 comprises a flexible portion intermediate between supports 110, 110'. It is this portion that is flexed during exercise. Greater resistance to flexure may be achieved by adjusting the supports closer together along the spring. Less resistance may be achieved by adjusting the supports further apart.

The lower ends of supports 110, 110' are configured for resting on a flat surface, such as on a floor or tabletop. Preferably, the ends are shaped to permit pivoting of the supports in a plane parallel to the principal plane of flexure of the leaf spring 102. In the depicted embodiment, this functionality is provided by rollers 112, 112' supporting each support at its lower end. Each support 110, 110' may be constructed using a formed piece of sheet metal, or in any other suitable manner.

Actuators 114, 114' may be configured as cams that pivot around pins on their respective supports. Pivoting the actuators to their clamped position rotates the cam-shaped end of the actuator so that the leaf spring is compressed between the cam and an upper portion of the support. Pivoting the actuator in an opposite direction releases the cam pressure. One of ordinary skill may devise other suitable clamping actuators for supports 110, 110'.

Apparatus 100 may additionally comprise a cushioning pad 104 slideably mounted above spring 102. Pad 104 may comprise a foam material inside a protective cover. In the alternative, pad 104 may be fixed to an upper surface of spring 102, such as by using an adhesive. Pad 104 is configured to rest against the forehead of a user during exercise.

FIGS. 2–4 show other views of the preferred embodiment. FIG. 2 shows apparatus 100 in plan view, looking from above the leaf spring. A side view is shown in FIG. 3. Actuator 114 is shown in a released position using a dotted outline at the left of the figure. FIG. 4 shows an end view, showing details of the actuator and clamping structure in support 110. Spring 102 is compressed against the upper portion 116 of the support by the opposing cam pieces 120, 120'. The cam pieces 120, 120' are joined by bar 118 and cylindrical sleeve 122, which provides a hub for pivoting the actuator around a pin passing though opposing arms of the support 110.

FIG. 5 shows apparatus 100 as it may be flexed during exercise by a force "F." The force is applied to an upper surface of the leaf spring midway between supports 110, 110'. Leaf spring 102 flexes as shown, causing the supports to pivot outward on their respective rollers over support surface 124. Thus, the rollers facilitate smooth, back-and-forth motion over surface 124 during cyclical flexure. Advantageously, the flexure is symmetrical about the center of force, and the spring reaction force operates along a straight vertical line in opposition to the applied force, throughout the exercise cycle.

In an alternative embodiment as shown in FIG. 6, exercise apparatus 200 comprises a leaf spring 202 fixed to support 208, which is configured as a simple column support that is not readily removed from the leaf spring. A lower end of support 208 may be rounded to facilitate rotation relative to a lower support surface. Support 210 may be the same as supports 110, 110' described above. Apparatus 200 is shown in an exemplary flexed position caused by application of a force "F."

Having thus described a preferred embodiment of the neck exercise apparatus, it should be apparent to those skilled in the art that certain advantages of the within system have been achieved. It should also be appreciated that various modifications, adaptations, and alternative embodiments thereof may be made within the scope and spirit of the present invention. For example, a prototype unit in a utilitarian style is depicted, but many components could be formed using molded and more aesthetically styled designs. The invention is defined by the following claims, which are not limited to the preferred embodiment described herein.

What is claimed is:

1. An exercise apparatus, comprising:

a thin elongate leaf spring;

a first support clamped to the leaf spring, the first support comprising an actuator configured to move between a clamped position clamping the leaf spring between the actuator and an upper portion of the first support, and a released position retaining the leaf spring while permitting the leaf spring to slide relative to the first support, wherein a lower portion of the first support is configured for freely resting on a horizontal surface and the actuator of the first support comprises a cam disposed at an end of a pivoting arm; and a second support supporting the leaf spring and spaced a distance away from the first support, whereby the leaf spring is oriented substantially horizontally having a flexible portion intermediate between the first support and the second support.

2. The exercise apparatus of claim 1, further comprising a cushioned pad slideably attached to an upper surface of the leaf spring.

3. The exercise apparatus of claim 1, wherein the second support further comprises a second actuator configured to move between a clamped position clamping the leaf spring between the second actuator and an upper portion of the second support, and a released position retaining the leaf spring while permitting the leaf spring to slide relative to the second support, wherein a lower portion of the second support is configured for freely resting on a horizontal surface.

4. The exercise apparatus of claim 3, wherein the second actuator further comprises a cam disposed at an end of a pivoting arm.

5. The exercise apparatus of claim 1, wherein the second support further comprises a rounded lower end.

6. The exercise apparatus of claim 1, wherein the second support further comprises a roller mounted at a lower end of the second support.

7. The exercise apparatus of claim 1, wherein the first support further comprises a rounded lower end.

8. The exercise apparatus of claim 1, wherein the first support further comprises a roller mounted at a lower end of the first support.

9. The exercise apparatus of claim 1, wherein the leaf spring comprises a stainless steel sheet.

10. The exercise apparatus of claim 1, wherein the leaf spring comprises a sheet of fiber composite material.

11. An exercise apparatus, comprising:

a thin elongate leaf spring;

a first support clamped to the leaf spring, the first support comprising an actuator configured to move between a clamped position clamping the leaf spring between the actuator and an upper portion of the first support, and a released position retaining the leaf spring while permitting the leaf spring to slide relative to the first support, wherein a lower portion of the first support is configured for freely resting on a horizontal surface; and a second support supporting the leaf spring and spaced a distance away from the first support, whereby the leaf spring is oriented substantially horizontally having a flexible portion intermediate between the first support and the second support, wherein the second support comprises a roller mounted at a lower end of the second support.

12. The exercise apparatus of claim 11, further comprising a cushioned pad attached to an upper surface of the leaf spring.

13. The exercise apparatus of claim 11, wherein the second support further comprises a second actuator configured to move between a clamped position clamping the leaf spring between the second actuator and an upper portion of the second support, and a released position retaining the leaf spring while permitting the leaf spring to slide relative to the second support, wherein a lower portion of the second support is configured for freely resting on a horizontal surface.

14. The exercise apparatus of claim 13, wherein the second actuator further comprises a cam disposed at an end of a pivoting arm.

15. The exercise apparatus of claim 11, wherein the first support further comprises a rounded lower end.

16. The exercise apparatus of claim 11, wherein the first support further comprises a roller mounted at a lower end of the first support.

17. The exercise apparatus of claim 11, wherein the leaf spring comprises a stainless steel sheet.

18. The exercise apparatus of claim 11, wherein the leaf spring comprises a sheet of fiber composite material.

19. An exercise apparatus, comprising:

a thin elongate leaf spring;

a first support clamped to the leaf spring, the first support comprising an actuator configured to move between a clamped position clamping the leaf spring between the actuator and an upper portion of the first support, and a released position retaining the leaf spring while permitting the leaf spring to slide relative to the first support, wherein a lower portion of the first support is configured for freely resting on a horizontal surface, and the first support comprises a roller mounted at a lower end of the first support; and a second support supporting the leaf spring and spaced a distance away from the first support, whereby the leaf spring is oriented substantially horizontally having a flexible portion intermediate between the first support and the second support.

20. The exercise apparatus of claim 19, wherein the second support further comprises second actuator configured to move between a clamped position clamping the leaf spring between the second actuator and an upper portion of the second support, and a released position retaining the leaf spring while permitting the leaf spring to slide relative to the second support, wherein a lower portion of the second support is configured for freely resting on a horizontal surface and the second actuator comprises a cam disposed at an end of a pivoting arm.

* * * * *

UNITED STATES PATENT AND TRADEMARK OFFICE

CERTIFICATE OF CORRECTION

PATENT NO. : 7,041,033 B2
APPLICATION NO. : 10/838012
DATED : May 9, 2006
INVENTOR(S) : James L. Tom It is certified that error appears in the above-identified patent and that said Letters Patent is hereby corrected as shown below:

On Title page, Item (76) Col. 1

INVENTOR ADDRESS SHOULD BE --6651-- (not 6551)

Signed and Sealed this

Fourth Day of July, 2006

JON W. DUDAS
*Director of the United States Patent and Trademark Office*